US007856961B2

(12) United States Patent
Doelker et al.

(10) Patent No.: US 7,856,961 B2
(45) Date of Patent: Dec. 28, 2010

(54) METHOD FOR AUTOMATIC PRESSURE CONTROL

(75) Inventors: Armin Doelker, Friedrichshafen (DE); Michael Prothmann, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 12/535,142

(22) Filed: Aug. 4, 2009

(65) Prior Publication Data

US 2010/0024773 A1 Feb. 4, 2010

(30) Foreign Application Priority Data

Aug. 4, 2008 (DE) ..... 10 2008 036 299

(51) Int. Cl.
*F02M 69/46* (2006.01)
*F02M 69/54* (2006.01)
*F02M 59/36* (2006.01)

(52) U.S. Cl. ..... 123/456; 123/457; 123/458

(58) Field of Classification Search ..... 123/357, 123/445, 446, 447, 457, 458, 481, 198 F, 123/198 DB, 497, 575, 456, 472, 478, 480, 123/696, 54.4; 701/102, 103, 104; 138/26, 138/30

See application file for complete search history.

(56) References Cited

U.S. PATENT DOCUMENTS 4,777,921 A * 10/1988 Miyaki et al. ..... 123/456
5,715,797 A * 2/1998 Minagawa et al. ..... 123/497
6,397,821 B1 * 6/2002 Spagele et al. ..... 123/486
7,219,655 B2 * 5/2007 Shinogle ..... 123/456
7,270,115 B2 * 9/2007 Dolker ..... 123/467
2007/0056561 A1 * 3/2007 Dolker ..... 123/458
2008/0092852 A1 * 4/2008 Bucher et al. ..... 123/457

FOREIGN PATENT DOCUMENTS

| | | |
|---|---|---|
| DE | 43 35 171 | 5/1995 |
| DE | 196 51 671 | 6/1998 |
| DE | 199 37 139 | 4/2001 |
| DE | 101 12 702 | 10/2002 |
| DE | 103 27 845 | 2/2004 |
| DE | 102 45 268 | 4/2004 |

(Continued)

*Primary Examiner*—Stephen K Cronin
*Assistant Examiner*—Raza Najmuddin
(74) *Attorney, Agent, or Firm*—Lucas & Mercanti, LLP; Klaus P. Stoffel

(57) ABSTRACT

A method for automatically controlling the pressure of a common rail system on an A side and a common rail system on a B side of a V-type internal combustion engine, in which the rail pressure (pCR(A)) of the common rail system on the A side is automatically controlled by an A-side closed-loop pressure control system, and the rail pressure (pCR(B)) of the common rail system on the B side is automatically controlled by a B-side closed-loop pressure control system. The automatic control of each side is independent of the other. A common set rail pressure is set as a reference input for both closed-loop pressure control systems. A set injection quantity is computed by a speed controller as a function of an actual speed relative to a set speed, and a common disturbance variable is computed as a function of the set injection quantity. Both the correcting variable of the A-side pressure controller and the correcting variable of the B-side pressure controller are corrected by the common disturbance variable.

7 Claims, 4 Drawing Sheets

FOREIGN PATENT DOCUMENTS

| | | |
|---|---|---|
| DE | 102 53 739 | 5/2004 |
| DE | 10 2004 023 365 | 12/2005 |
| DE | 601 12 681 | 6/2006 |
| DE | 10 2005 029 138 | 12/2006 |
| DE | 10 2006 049 266 | 3/2008 |
| EP | 0 892 168 | 1/1999 |

* cited by examiner

METHOD FOR AUTOMATIC PRESSURE CONTROL

BACKGROUND OF THE INVENTION

The invention concerns a method for automatically controlling the pressure of a common rail system on an A side and a common rail system on a B side of a V-type internal combustion engine.

V-type internal combustion engines have a rail on the A side and on the B side for temporary storage of the fuel. The injectors, which are connected to the rails, inject the fuel into the combustion chambers. In a first design of the common rail system, a high-pressure pump pumps the fuel into both rails at the same time, which is accompanied by an increase in pressure. Therefore, the same rail pressure prevails in both rails. A second design of the common rail system differs from the first in that a first high-pressure pump pumps the fuel into a first rail, and a second high-pressure pump pumps the fuel into a second rail. Both designs are described, for example, by DE 43 35 171 C1.

Since the quality of the combustion is critically dependent on the pressure level in the rails the pressure level is automatically controlled. Typically, a closed-loop pressure control system comprises a pressure controller, the suction throttle with high-pressure pump, the rail as the controlled system, and a filter in the feedback path. In this closed-loop pressure control system, the pressure level in the rail is the controlled variable. The measured raw values of the rail pressure are converted by the filter to an actual rail pressure, which is compared with a set rail pressure. The resulting control deviation is then converted by the pressure controller to a control signal for the suction throttle. The control signal corresponds to a volume flow in units of liters/minute, which is implemented electrically as a PWM (pulse-width-modulated) signal. A corresponding closed-loop pressure control system is known from DE 10 2006 049 266 B3.

An internal combustion engine provided as a generator drive is operated to realize a constant 50 Hz mains frequency in a closed-loop speed control system. The raw values of the controlled variable, i.e., the speed of revolution, are detected on the crankshaft, filtered, and compared as the actual speed with a reference input, the set speed. The resulting control deviation is then converted by a speed controller to the correcting variable, a set injection quantity.

A load reduction is a process that is difficult to control in an internal combustion engine with closed-loop pressure control and closed-loop speed control, first, due to its dynamics and, second, due to the different step response times of the two closed-loop control systems. Previously known measures for improving the response time in a load reduction, are regulation of injection start (DE 199 37 139 C1), switching to a faster speed filter (DE 10 253 739 B3) or pressure filter (DE 10 2004 023 365 A1), or temporarily increasing the PWM signal. In addition, DE 101 12 702 A1 discloses that in the case of large changes in dynamics, the response time of the closed-loop pressure control system can be improved by an input control variable. The high-pressure pump is controlled by the input control variable. The input control variable is computed from the set fuel quantity, the speed of the high-pressure pump, and the rail pressure.

A common feature of the methods described above is their use with a closed-loop pressure control system in a common rail system of the first design.

SUMMARY OF THE INVENTION

The object of the invention is to provide independent automatic pressure control of a common rail system on the A side and of a common rail system on the B side in a V-type internal combustion engine.

The invention achieves this objective by a method for automatic pressure control, in which the rail pressure of the common rail system on the A side is automatically controlled by an A-side closed-loop pressure control system, and the rail pressure of the common rail system on the B side is automatically controlled by a B-side closed-loop pressure control system, with the automatic control of each side being independent of the other, wherein a common set rail pressure is set as a reference input for both closed-loop pressure control systems. In addition, the method includes computing a set injection quantity by a speed controller as a function of an actual speed relative to a set speed, and in computing a common disturbance variable as a function of the set injection quantity. The correcting variable of the A-side pressure controller and the correcting variable of the B-side pressure controller are then corrected by means of the common disturbance variable.

The basic idea of the invention is thus to use the system-related higher dynamics of the closed-loop speed control system and, in the event of a load reduction, to shorten the step response time of the closed-loop pressure control systems. In accordance with the invention, the correcting variable of the speed controller, here: the set injection quantity, is used, from which the common disturbance variable is then determined to act on the closed-loop pressure control systems.

In a first embodiment of the invention, the common disturbance variable corresponds to a static disturbance variable, which is computed from the product of the set injection quantity, the actual speed, the number of cylinders of the internal combustion engine, and a factor. In a second embodiment, the common disturbance variable is a dynamic disturbance variable, which in turn is computed from the static disturbance variable by a PDT1 element.

The separate automatic pressure control for the common rail system on the A side and the common rail system on the B side allows separate diagnosis and control of the two suction throttles. If, for example, one of the two rail pressures is unstable, the given closed-loop control system can be controlled by separate variation of pressure controller parameters (P component, I component, DT1 component) or of the PWM base frequency. The coordination of systematic diagnosis and systematic reaction to it is thus advantageous.

DETAILED DESCRIPTION OF THE INVENTION

Figure 1:
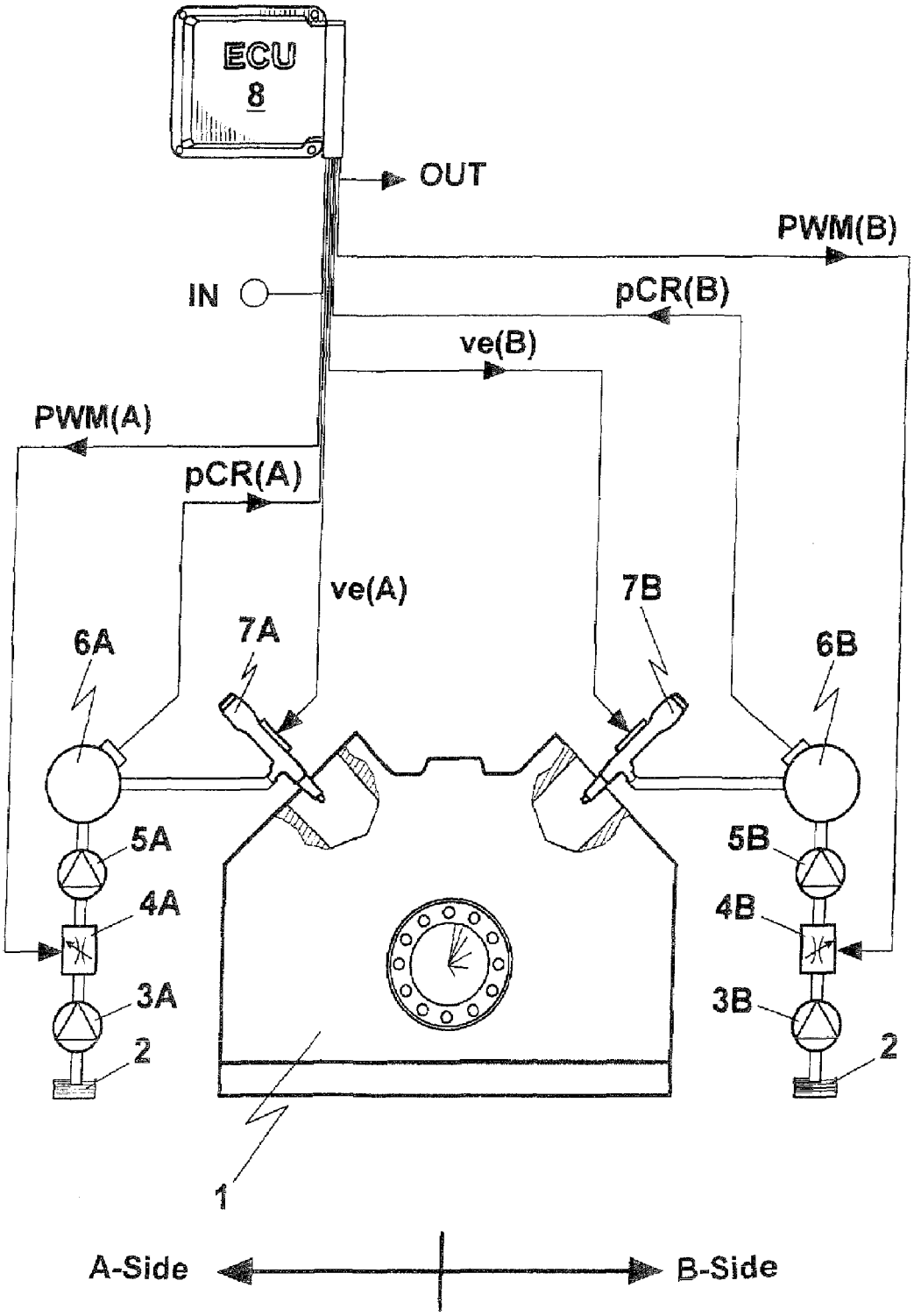
FIG. 1 shows a system diagram.

FIG. 1 shows a system diagram of an electronically controlled internal combustion engine 1 with a common rail system on the A side and a common rail system on the B side. The common rail system on the A side comprises the following mechanical components: a low-pressure pump 3A for pumping fuel from a tank 2, a suction throttle 4A for controlling the volume flow, a high-pressure pump 5A, a rail 6A, and injectors 7A for injecting fuel into the combustion chambers of the internal combustion engine 1. The common rail system on the B side comprises the same mechanical components, which have the same reference numbers but with the suffix B.

The internal combustion engine 1 is controlled by an electronic engine control unit (ECU) 8. As examples of input variables of the electronic engine control unit 8, FIG. 1 shows an A-side rail pressure pCR(A), a B-side rail pressure pCR (B), and a variable IN. The variable IN is representative of the other input variables, for example, an engine speed or a power desired by the operator. The illustrated output variables of the electronic engine control unit 8 are a PWM signal PWM(A) for controlling the A-side suction throttle 4A, a power-determining signal ve(A) for controlling the A-side injectors 7A, a PWM signal PWM(B) for controlling the B-side suction throttle 4B, a power-determining signal ve(B) for controlling the B-side injectors 7B, and a variable OUT. The variable OUT is representative of the other control signals for controlling the internal combustion engine 1, for example, a control signal for controlling an AGR valve. Naturally, the common rail system illustrated here can also be realized as a common rail system with individual accumulators. The characterizing feature of the embodiment illustrated here is the mutually independent automatic control of the A-side rail pressure pCR(A) and the B-side rail pressure pCR(B).

Figure 2:
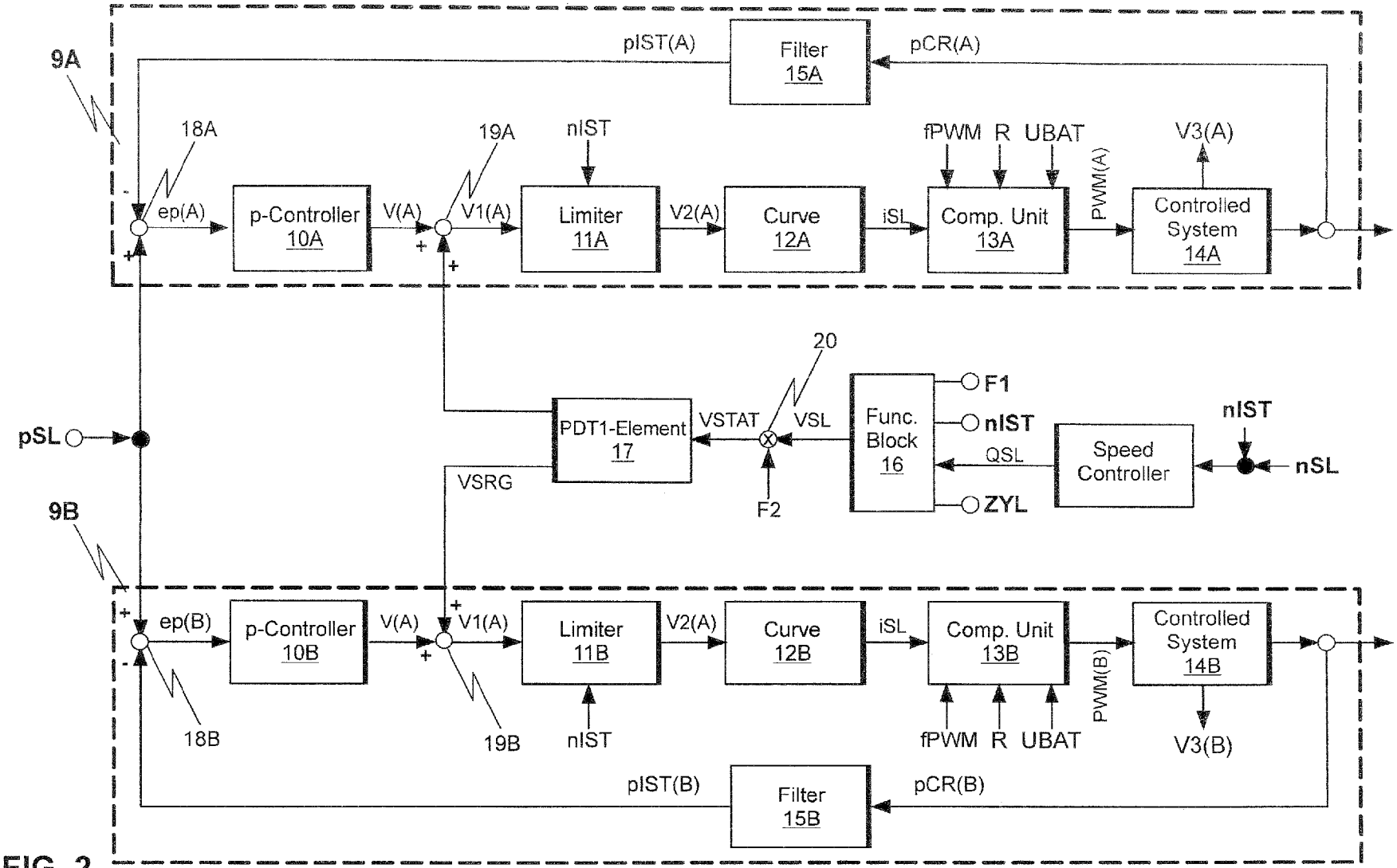
FIG. 2 shows a block diagram of the two closed-loop pressure control systems.

FIG. 2 shows a block diagram of the two closed-loop pressure control systems. The components of the A-side closed-loop pressure control system 9A are identified by reference numbers with the suffix A, while the components of the B-side closed-loop pressure control system 9B are identified by reference numbers with the suffix B. The configuration of both closed-loop control systems is identical. The A-side closed-loop pressure control system 9A is described below, and this description applies analogously to the B-side closed-loop pressure control system 9B. The reference input for both closed-loop pressure control systems is identical, here: a common set rail pressure pSL.

The input variables of the A-side closed-loop pressure control system 9A are the set rail pressure pSL, a common disturbance variable VSRG in units of liters/minute, the actual speed nIST, a base frequency fPWM for the PWM signal, the battery voltage UBAT, and the ohmic resistance R of the suction throttle (FIG. 1: 4A), including the lead wire. The output variables of the A-side closed-loop pressure control system are the raw values of the rail pressure pCR(A). An actual rail pressure pIST(A) is determined from the raw values of the rail pressure pCR(A) by means of a filter 15A. The actual rail pressure pIST(A) is compared with the set rail pressure pSL at a point 18A. This comparison yields the control deviation ep(A), from which a pressure controller 10A with at least PID action computes a correcting variable V(A). The correcting variable V(A) corresponds to a volume flow with the physical unit of liters/minute. At a point 19A, the correcting variable V(A) and the common disturbance variable VSRG are added to each other and conveyed to a limiter 11A as an input signal V1(A). The limiter 11A limits the value of the input signal V1(A) as a function of the actual speed nIST. If the value of the input signal V1(A) is below the limiting value, the value of the output signal V2(A) corresponds to the value V1(A). A set electric current iSL is assigned to the output signal V2(A) by a pump characteristic curve 12A. The set current iSL is then converted to a PWM signal PWM(A) in a computing unit 13A. The PWM signal PWM(A) is the duty cycle, and the frequency fPWM corresponds to the base frequency. The conversion takes into consideration the following factors, among others: the fluctuations of the operating voltage UBAT and the ohmic resistance R of the suction throttle, including the electric lead wires. The solenoid of the suction throttle is then acted upon by the PWM signal PWM(A). This results in a change in the displacement of the magnetic core, by which the pumping current of the high-pressure pump is freely controlled. The high-pressure pump 5A, the suction throttle 4A and the rail 6A constitute an A-side controlled system 14A. A consumption volume flow V3(A) is removed from the rail 6A by the injectors 7A. The A-side closed-loop control system 9A is thus closed.

A functional block 16 computes a set consumption VSL from the actual speed nIST, the set injection quantity QSL, the number of cylinders ZYL of the internal combustion engine 1, and a first factor F1. The set injection quantity QSL is the output variable of a speed controller (not shown), i.e., its correcting variable. The set consumption VSL is computed by multiplying the input variables with one another. At a point 20, the set consumption VSL is then multiplied by a second factor, for example, 0.5. The computed signal corresponds to a static disturbance variable VSTAT. In a first embodiment (not shown), this disturbance variable is sent directly to the points 19A and 19B, i.e., the common disturbance variable VSRG is identical with the static disturbance variable VSTAT. In a second embodiment, which is the embodiment shown here, a dynamic disturbance variable is formed from the static disturbance variable VSTAT by the PDT1 element and constitutes the common disturbance variable VSRG. The common disturbance variable VSRG is then sent to the two points 19A and 19B, where it is added to the correcting variable V(A) of the A-side pressure controller 10A and to the correcting variable V(B) of the B-side pressure controller 10B.

In an embodiment that is not shown here, a closed-loop current control system is provided, which is subordinate to both the A-side closed-loop pressure control system 9A and the B-side closed-loop pressure control system 9B and by which the regulating current of the suction throttle (FIG. 1: 4A, 4B) is automatically controlled. A closed-loop current control system of this type with input control is known, for example, from DE 10 2004 061 474 A1.

As shown in the block diagram of FIG. 2, higher dynamics of the closed-loop pressure control systems during a load reduction are achieved by virtue of the fact that the common disturbance variable VSRG acts to correct the correcting variable of the pressure controller. The common disturbance variable VSRG in turn is determined to a great extent by the correcting variable of the speed controller, i.e., the set injection quantity QSL, which has very high, system-related dynamics. The separate automatic pressure control for the common rail system on the A side and the common rail system on the B side allows separate diagnosis and control of the two suction throttles. If, for example, one of the two rail pressures is unstable, the given closed-loop control system can be controlled by separate variation of pressure controller parameters (P component, I component, DT1 component) or of the PWM base frequency fPWM. The coordination of systematic diagnosis and systematic reaction to it is thus advantageous.

FIG. 3 consists of the graphs 3A to 3E, which show various state variables during a load reduction. The following are plotted as a function of time t: a signal PL that characterizes the load in FIG. 3A, the actual speed nIST in FIG. 3B, the set injection quantity QSL in FIG. 3C, the set consumption VSL in FIG. 3D, and the A-side actual rail pressure pIST(A) in FIG. 3E. In FIGS. 3D and 3E, the solid line represents the behavior when a static disturbance variable is applied (FIG. 2: VSTAT), and the dot-dash line represents the behavior when a dynamic disturbance variable is applied. In FIG. 3E, the A-side actual rail pressure pIST(A) is shown by way of example; the B-side actual rail pressure pIST(B) shows analogous behavior.

Figure 3A:
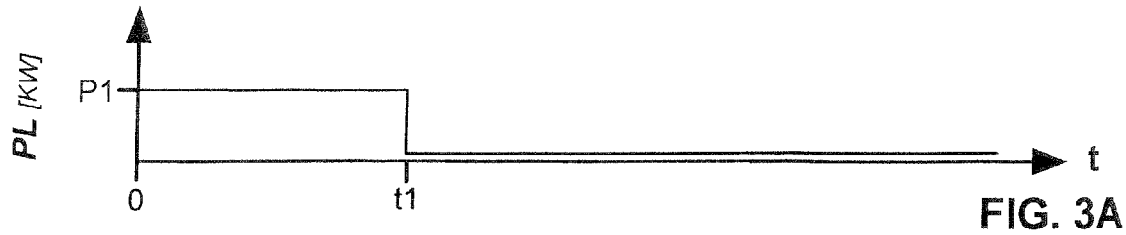
FIG. 3 shows various characteristics over time.
Figure 3B:
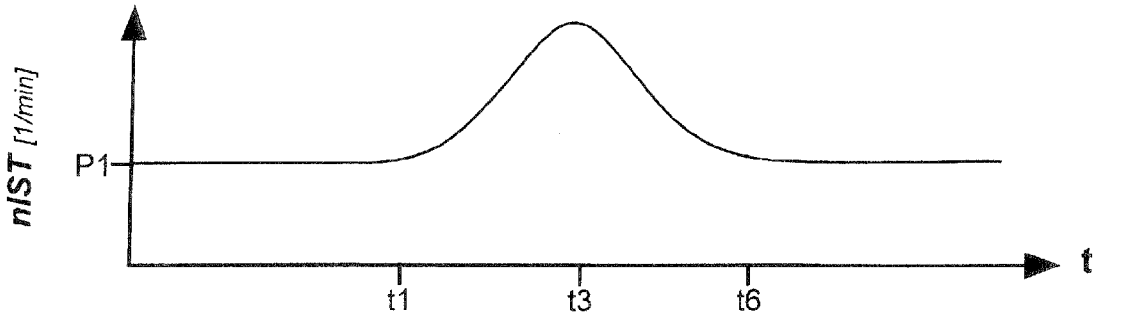
Figure 3C:
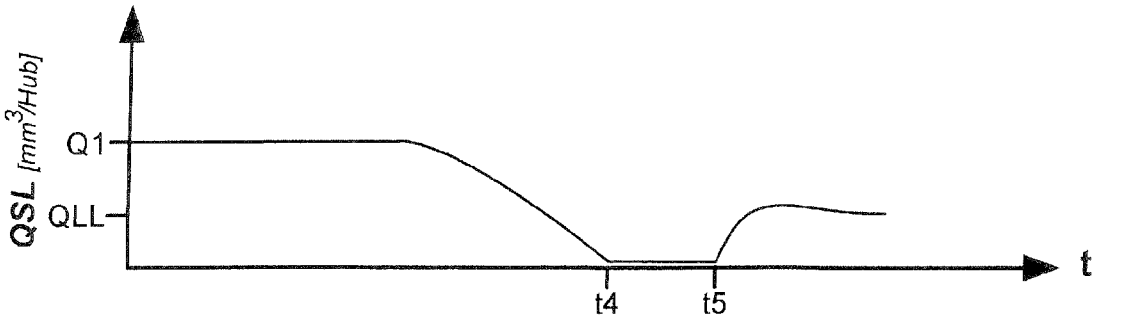
Figure 3D:
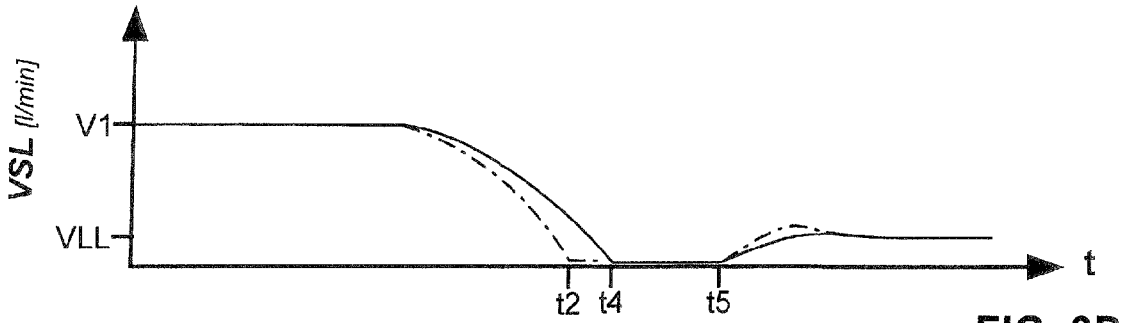

At time t1, the consumer power is abruptly reduced. In FIG. 3A, therefore, the signal PL drops from a first value P1 to zero. As a result of this load reduction, the actual speed nIST of the internal combustion engine 1 starts to increase at time t1. The speed controller detects the rise of the actual speed nIST by the speed control deviation (set speed=constant). The speed controller responds to this by decreasing its correcting variable, here: the set injection quantity QSL, starting at time t1. The actual speed nIST reaches its maximum value at time t3. Due to the sharply rising actual speed nIST, the speed controller initially reduces the set injection quantity QSL to below a set injection quantity for idling QLL and then to zero at time t4. The set fuel consumption VSL is computed from the actual speed nIST and the set injection quantity QSL by multiplying them by the number of cylinders of the internal combustion engine (VSL~nIST·QSL·ZYL). In conformity with the set injection quantity QSL, the set fuel consumption VSL likewise has a decreasing curve, first, to below a set fuel consumption VLL and then to zero at time t4 (FIG. 3D). In the illustrated example, it is assumed that in the time interval t4/t5, the set injection quantity QSL and therefore the set fuel consumption VSL as well remain at zero.

A reduced set injection quantity QSL means that less fuel is removed from the rail. At the same time, however, the high-pressure pump is pumping more fuel into the rail, since the high-pressure pump is mechanically driven by the internal combustion engine, and an increasing actual speed nIST brings about a higher pumping capacity. The lower set injection quantity QSL and the higher pumping capacity of the high-pressure pump cause increased pressure in the rail. This increase in pressure is clearly apparent in FIG. 3E, starting from a first pressure level p1 of the A-side actual rail pressure pIST(A). The maximum value of the A-side actual rail pressure is reached at time t5 with a static disturbance variable is applied.

Figure 3E:
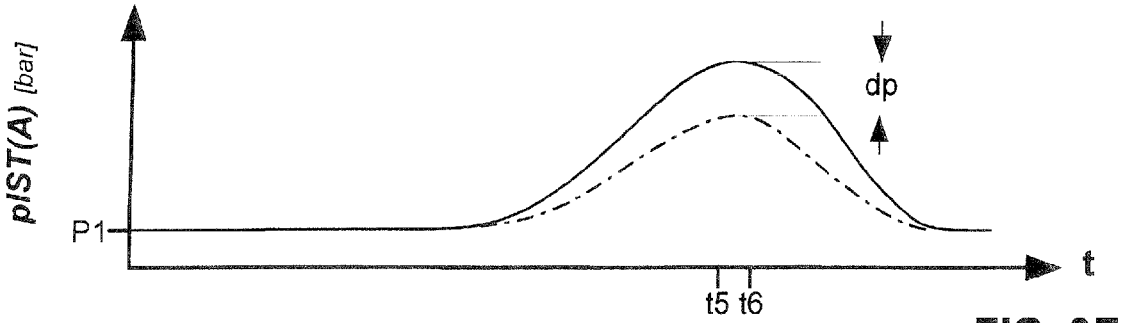

If a dynamic disturbance variable is applied, the decline of the set fuel consumption VSL is intensified (see the dot-dash line and time t2 in FIG. 3D). The more rapid decline of the set fuel consumption VSL has the effect that the A-side actual rail pressure pIST(A) rises more slowly, and its maximum value is smaller than the maximum value when a static disturbance variable is applied (time t6). In FIG. 3E, this pressure differential is indicated as dp.

Figure 4:
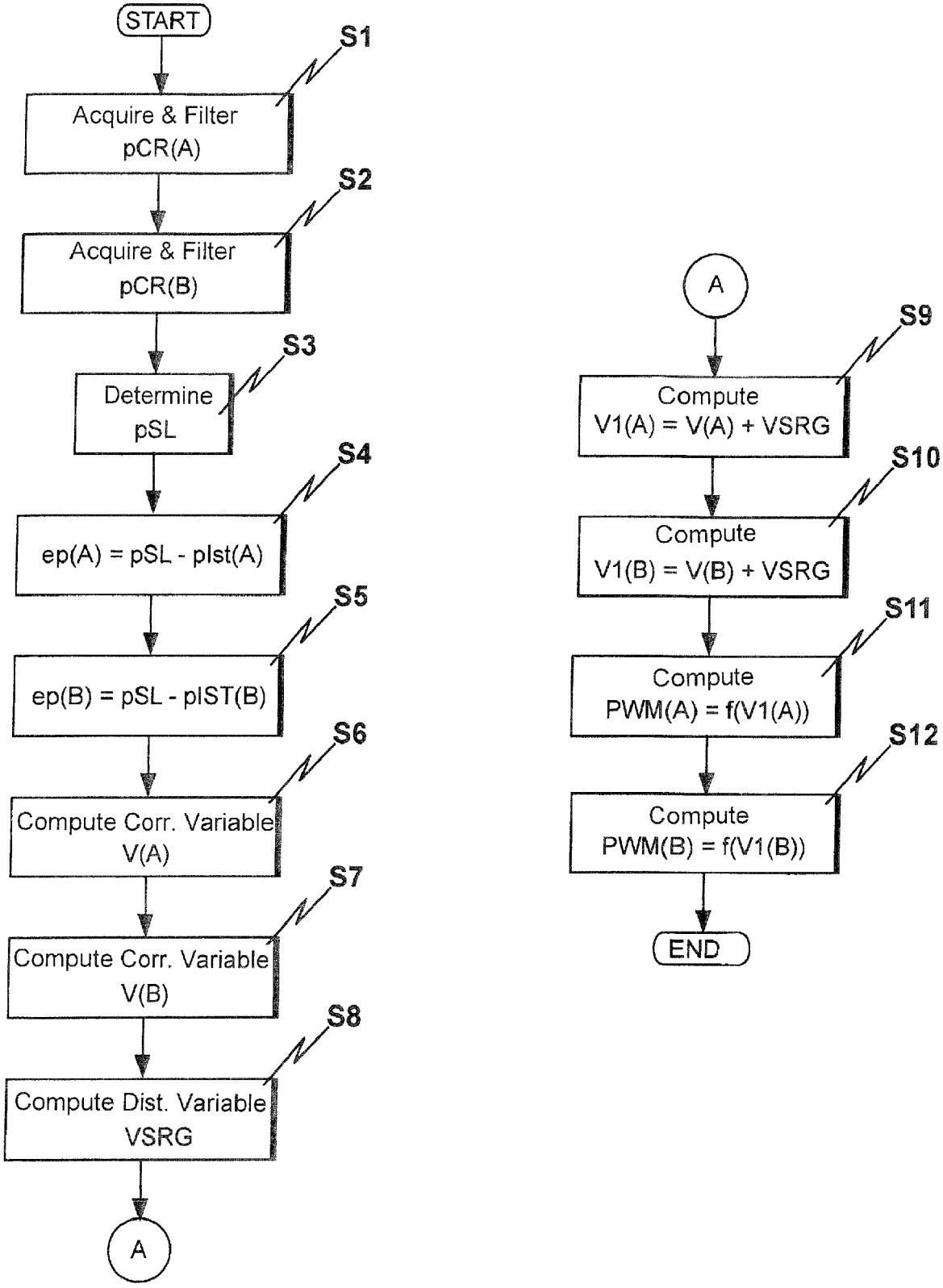
FIG. 4 shows a program flowchart.

In FIG. 4, the method of the invention is described in a program flowchart. At S1 the raw values of the A-side rail pressure pCR(A) are acquired and filtered. The filtered value then corresponds to the A-side actual rail pressure pIST(A). At S2 the B-side actual rail pressure pIST(B) is similarly determined. The common set rail pressure pSL is then determined at S3. The common set rail pressure pSL can either be preset as a constant value or computed by an efficiency map as a function of a set torque or, alternatively, as a function of the set injection quantity QSL and the actual speed nIST. At S4 an A-side control deviation ep(A) is computed from the deviation of the A-side actual rail pressure pIST(A) from the common set rail pressure pSL. The B-side control deviation ep(B) is similarly determined at S5. At S6 the A-side correcting variable V(A), which is typically a volume flow in units of liters/minute, is then computed by the A-side pressure controller. At S7 the B-side correcting variable V(B) is determined by the B-side pressure controller on the basis of the B-side control deviation ep(B). At S8 the common disturbance variable VSRG is computed, either as a static disturbance variable or as a dynamic disturbance variable, which is computed from the static disturbance variable by the PDT1 element. At S9 the correcting variable V(A) of the A-side pressure controller and the common disturbance variable VSRG are added to each other. The result corresponds to a volume flow, which represents the input signal V1(A) for the limiter. Similarly, an input signal V1(B) is computed at S10 as the sum of the correcting variable V(B) of the B-side pressure controller and the common disturbance variable VSRG. A corresponding PWM signal PWM(A) for controlling the A-side suction throttle is then computed at S11, and a PWM signal PWM(B) for controlling the B-side suction throttle is computed at S12. The program flowchart then ends.

Although the present invention has been described in relation to particular embodiments thereof, many other variations and modifications and other uses will become more apparent to those skilled in the art. It is preferred, therefore, that the present invention be limited not by the specific disclosure herein, but only by the appended claims.

The invention claimed is:

1. A method for automatically controlling pressure of a common rail system on an A side and a common rail system on a B side of a V-type internal combustion engine, comprising the steps of:

automatically controlling rail pressure (pCR(A)) of the common rail system on the A side by an A-side closed-loop pressure control system, the common rail system on the A side having at least one injector;

automatically controlling rail pressure (pCR(B)) of the common rail system on the B side by a B-side closed-loop pressure control system, the common rail system on the B side having at least one injector, the automatic control of each side being independent of the other, including setting a common set rail pressure (pSL) as a reference input for both closed-loop pressure control systems; and computing a set injection quantity (QSL) by a speed controller as a function of an actual speed (nIST) relative to a set speed (nSL), computing a common disturbance variable (VSRG) as a function of the set injection quantity (QSL), and correcting both a correcting variable (V(A)) of the A-side pressure controller and a correcting variable (V(B)) of the B-side pressure controller using the common disturbance variable (VSRG).

2. The method in accordance with claim 1, wherein the common disturbance variable (VSRG) corresponds to a static disturbance variable (VSTAT), which is computed from the product of the set injection quantity (QSL), the actual speed (nIST), the number of cylinders (ZYL), and factors (F1, F2).

3. The method in accordance with claim 2, wherein the common disturbance variable (VSRG) is a dynamic disturbance variable, which is computed from the static disturbance variable (VSTAT) by a PDT1 element.

4. The method in accordance with claim 1, and further comprising providing a closed-loop current control system, which is subordinate to both the A-side closed-loop pressure control system and the B-side closed-loop pressure control system, for automatically controlling the regulating current of a suction throttle.

5. The method in accordance with claim 1, wherein the common set rail pressure (pSL) is preset as a constant value.

6. The method in accordance with claim 1, wherein the common set rail pressure (pSL) is computed as a function of a set torque.

7. The method in accordance with claim 1, wherein the common set rail pressure (pSL) is computed as a function of the set injection quantity (QSL) and the actual speed (nIST).

* * * * *